US005427092A

United States Patent [19]

Shiao

[11] Patent Number: 5,427,092

[45] Date of Patent: Jun. 27, 1995

[54] RESPIRATOR

[76] Inventor: Chuan-Ju Shiao, No. 712, Liu Tzu Lin, Shui Shang Hsiang, Chia Yi Hsien, Taiwan

[21] Appl. No.: 159,302

[22] Filed: Nov. 30, 1993

[51] Int. Cl.[6] ..... A62B 23/00

[52] U.S. Cl. ..... 128/206.12; 128/206.17; 128/205.29

[58] Field of Search ..... 128/205.29, 206.12, 128/206.17, 206.21, 206.28, 206.19

[56] References Cited

U.S. PATENT DOCUMENTS

| | | | |
|---|---|---|---|
| 3,944,403 | 3/1976 | Simpson et al. | 128/206.17 |
| 4,098,270 | 7/1978 | Dolby | 128/206.12 |
| 4,784,131 | 11/1988 | Schroeder | 128/206.18 |
| 4,790,306 | 12/1988 | Braun et al. | 128/206.12 |
| 4,827,924 | 5/1989 | Japuntieh | 128/206.12 |
| 5,010,594 | 4/1991 | Suzuki et al. | 128/206.12 |
| 5,022,901 | 6/1991 | Meunier | 128/206.17 |
| 5,033,465 | 7/1991 | Braun et al. | 128/206.12 |
| 5,078,132 | 1/1992 | Braun et al. | 128/206.12 |

FOREIGN PATENT DOCUMENTS

| | | | |
|---|---|---|---|
| 558497 | 12/1957 | Belgium | 128/206.12 |

*Primary Examiner*—Edgar S. Burr
*Assistant Examiner*—V. Srivastava
*Attorney, Agent, or Firm*—Morton J. Rosenberg; David I. Klein

[57] ABSTRACT

A respirator (1) is composed of a respirator casing having a pair of rectangularly contoured frames (12) mounted around rectangular apertures (11) on respective sides of the respirator (1). The apertures (11) are adapted to receive a pair of air filter sets to filter out foreign particles and provide clean air to the wearer. Each filter set (2) is composed of inner and outer filters (21 and 22). Each of the inner and outer filters (21 and 22) includes a receiving frame (213 and 223) adapted to receive a dust protective layer (214 and 224) by means of a respective cover (215 and 225) to press the respective dust protective layer (214 and 224) inwardly. Upon the air filter set (2) being mounted in the frame (12) of the respirator (1), an air passage is formed between the inner and outer filters (21 and 22) for air to flow and most of the dirty particles are blocked from passage and are entrapped on the dust protective layer (214 and 224) to allow clean air to pass into the respirator (1).

6 Claims, 6 Drawing Sheets

A – A

RESPIRATOR

BACKGROUND OF THE INVENTION

1. Field of the Invention

This invention relates to a respirator. More particularly, this invention pertains to a respirator having a pair of air filter sets assembled at respective sides of the respirator to block dirty particles and to permit air to pass therethrough which provides clean and fresh air to the wearer.

2. Prior Art

Respirators of various types are sold in the market. The prior art respiration mouthpieces are generally formed having a filter fastened at a front end, or at respective sides thereof by means of elastic cord. Such prior art respirators are deficient in filtering out dirty particles and tend to shift from one side to the other causing the wearer discomfort.

In view of this, the inventor has developed the present respirator which obviates the above mentioned shortcomings.

SUMMARY OF THE INVENTION

It is the primary object of the present invention to provide a respirator which isolates dirty particles from the wearer's respiratory system and permits fresh air to flow into the respirator.

It is another object of the present invention to provide a respirator where replacement of filters is simple.

It is a further object of the present invention to provide a respirator where filter sets will not randomly shift their positions.

DETAILED DESCRIPTION OF THE PREFERRED EMBODIMENT

Figure 1:
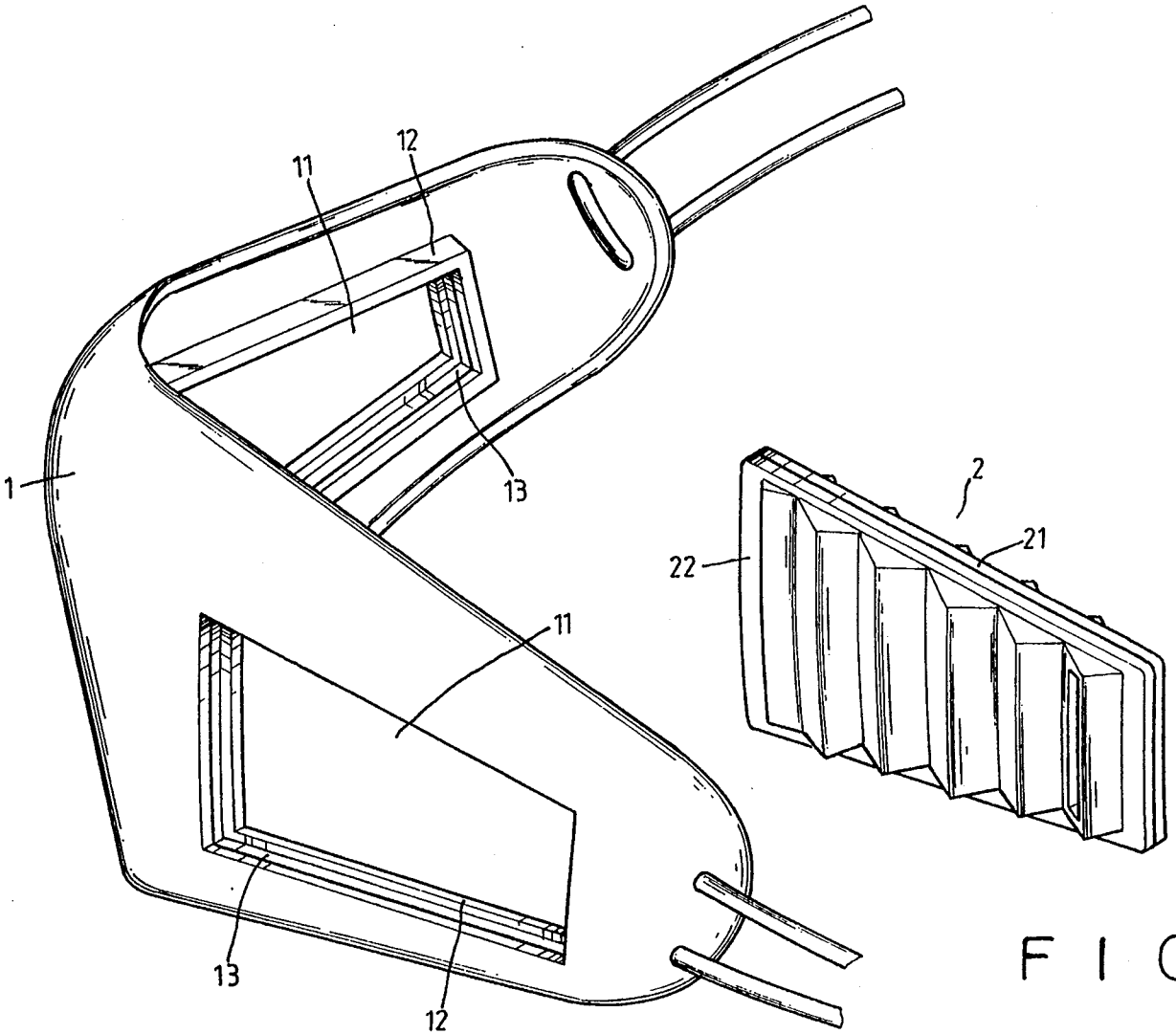
FIG. 1 is a perspective view of the respirator of the present invention showing an air filter set disengaged from the respirator.
Figure 3:
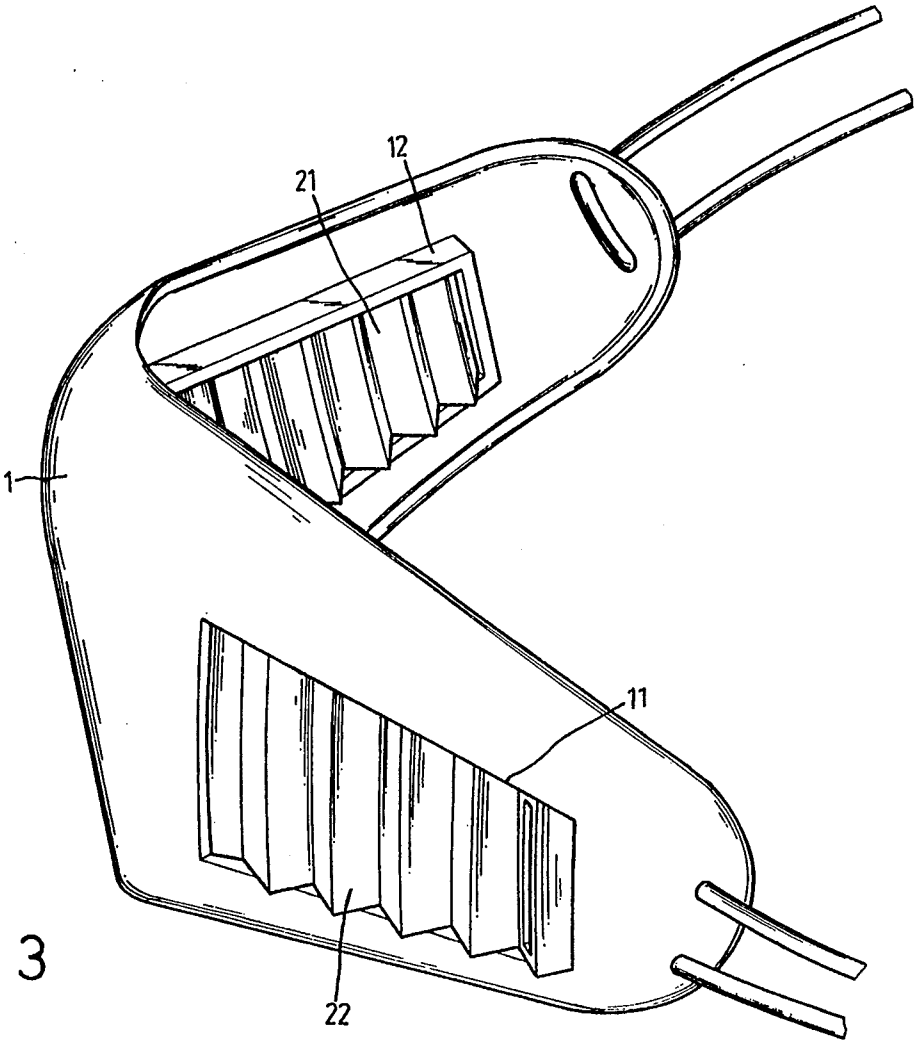
FIG. 3 is a perspective view of FIG. 1.

Referring to the drawings, in particular to FIGS. 1 and 3, a respirator 1 formed of appropriate plastic material is shown. Respirator 1 includes a respirator casing having a pair of rectangular apertures 11 having a pair of integrally formed rectangular frames 12, each of which has a groove 13 on the inner center portion, respectively, adapted to receive an air filter set 2 therein.

Figure 2:
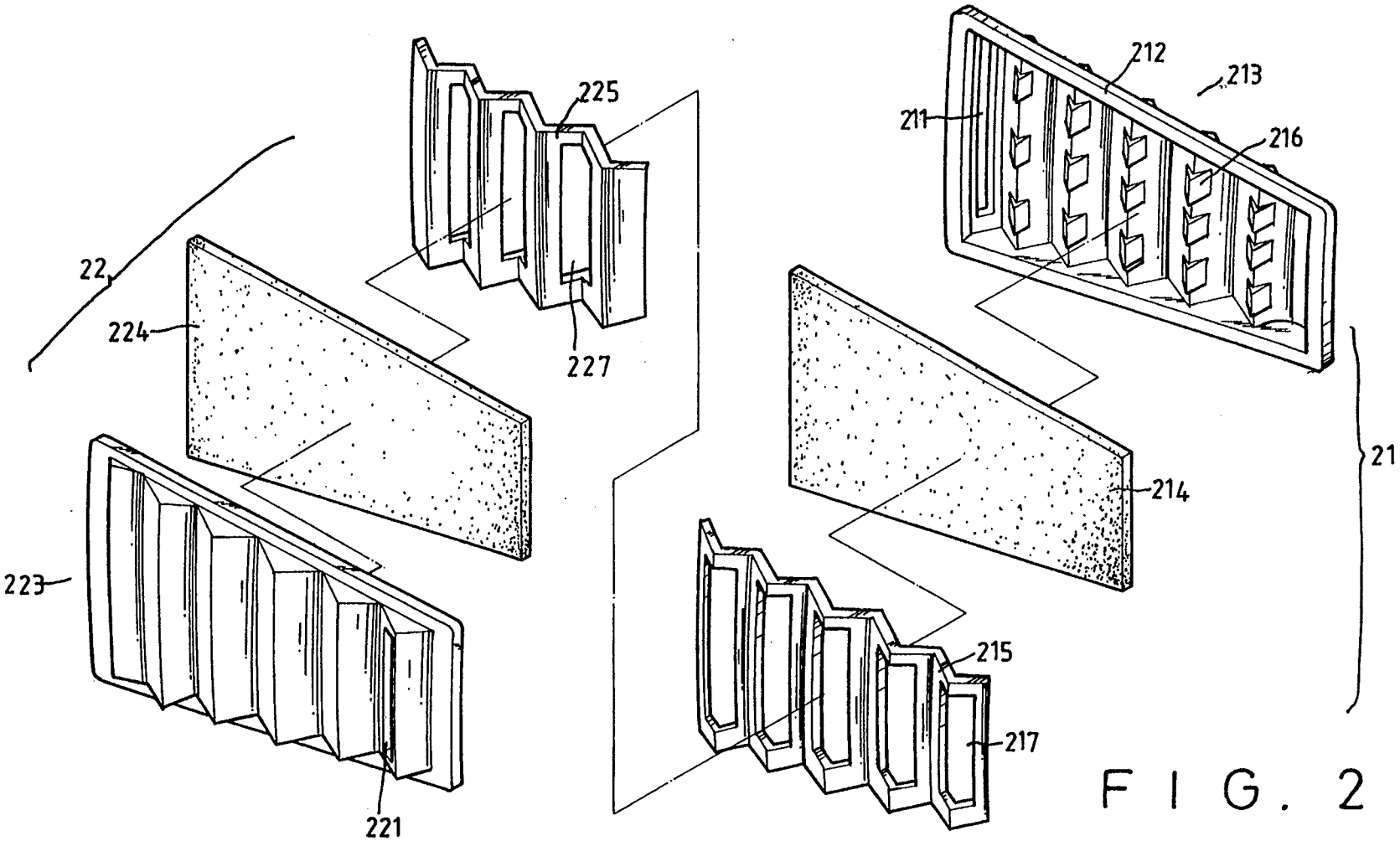
FIG. 2 is an exploded view of the filter set of FIG. 1.
Figure 6:
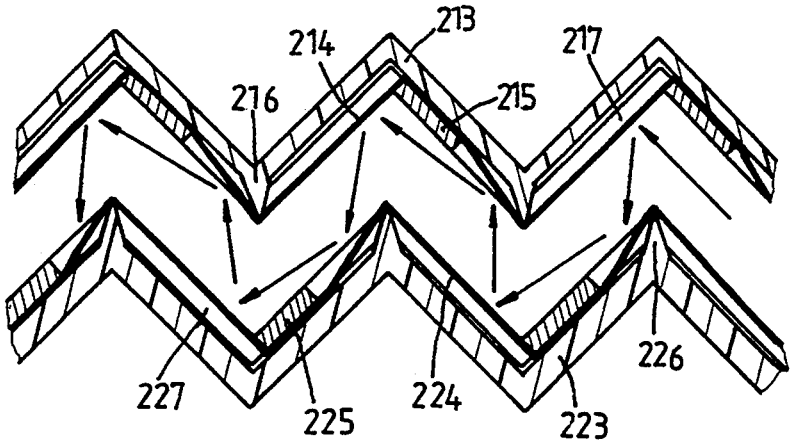
FIG. 6 is another sectional view taken along line B—B of FIG. 4.

Each air filter set 2 includes an inner filter 21 and an outer filter 22. The inner filter 21, as shown in FIG. 2, is composed of a receiving frame 213 having a continuous peripheral wall integrally formed to one side of the receiving frame 213 and having formed a flange 212 thereon. Each receiving frame 213 has an inner filter wall member having a plurality of triangle blocks 216 defining the wall member. A longitudinal trough or opening 211 is formed at one side of the wall member which is adapted to expel air breathed out by a wearer for forcing the air external the respirator. The opening or trough 211 is located at an innermost position of the respiration 1 after assembly. A dust protective layer 214 is detachably attached to the receiving frame 213 by means of a cover 215 pressing the dust protective layer 214 against the receiving frame 213. The cover 215 has the same shape or contour as the receiving frame 213 but is smaller in size than the receiving frame 213 and includes a plurality of 25 longitudinally directed apertures 217 adapted for the triangular blocks to extend therein. The triangular blocks 216 extending from the apertures 217 are adapted to force some portions of the dust protective layer 214 to extend through and outwardly of the cover 215 for the purpose of blocking any dirty particles from entering the respiratory 1 and being inhaled by the wearer as shown in FIG. 6.

The outer filter 22 is identical to the inner filter 21 with one exception that a trough 221 which is formed at one side of the peripheral wall of the receiving frame 223 for fresh air to flow into the respirator 1 is located at the outmost position when assembled to the respirator 1. Thus, the outer filter 22 includes a flange 222 corresponding to flange 212 of the inner filter 21, a cover 225 with apertures 227 and a dust protective layer 224 corresponding to dust protective layer 214.

Figure 4:
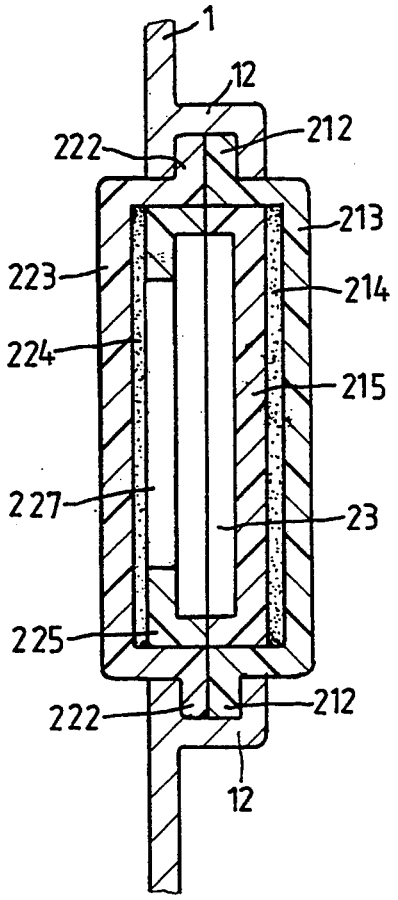
FIG. 4 is a perspective view similar to FIG. 3, partially sectioned.
Figure 5:
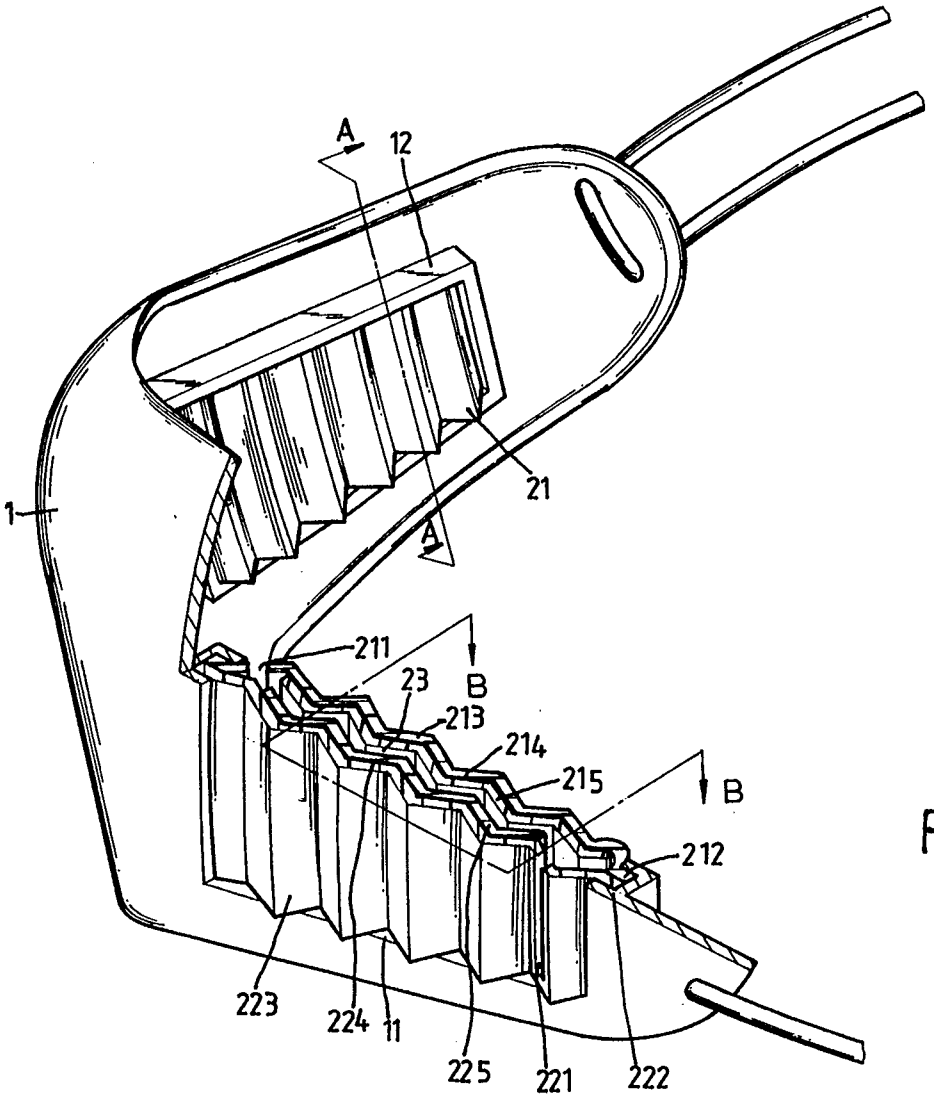
FIG. 5 is a sectional view taken along line A—A of FIG. 4.

In order to assemble the filter set 2, a user inserts the inner and outer filters 21, 22 into the rectangular frames 12 with the receiving flanges 212, 222 inserted into the grooves 13, respectively as shown in FIG. 4. A passage 23 is formed in between the inner and the outer filters 21, 22, as shown in FIG. 5, which is adapted for air to flow along the passage.

Figure 7:
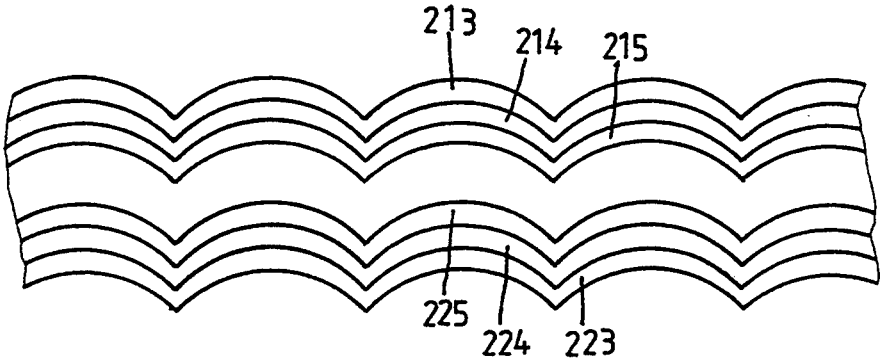
FIG. 7 is a plan view of the air filter set of a second embodiment.
Figure 8:
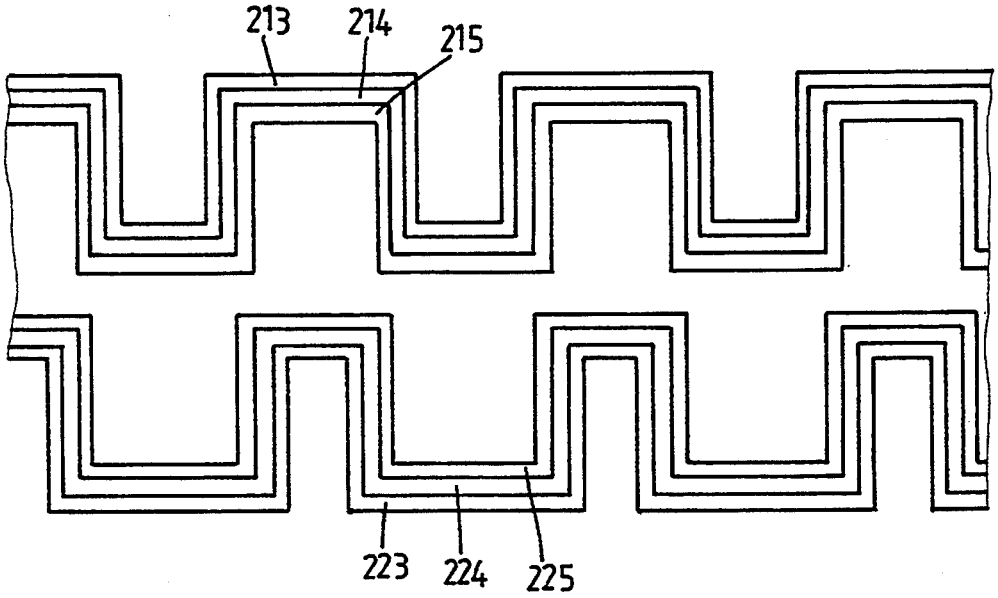
FIG. 8 is a plan view of the air filter set of a third embodiment.

While the invention has been particularly shown and described with reference to a preferred embodiment, it will be understood by those skilled in the art that various changes in form and detail can be made therein without departing from the spirit and scope of the invention. For example, the shape of the filters 21, 22 can be changed from a curve to a wave shape, as shown in FIG. 7 or to a square shape, as shown in FIG. 8.

I claim:

1. A respirator comprising:

(a) a respirator casing having a pair of substantially rectangularly contoured apertures formed therethrough, each of said rectangularly contoured apertures having a respective rectangularly contoured frame member extending in an internal direction from an inner surface of said respirator casing and extending around said respective aperture, each of said frame members having a groove formed therein;

(b) a pair of inner rectangularly contoured filters, each of said inner filters having an inner filter receiving frame insertable within a respective aperture of said respirator casing and having a closed contour flange insertable within said groove of a respective one of said frame members, each of said inner filter receiving frames having an inner filter wall member of undulating contour and having an outlet air opening formed through one end thereof, each of said inner filters having an inner flexible dust protective member sandwiched between said inner filter wall member and an inner filter wall cover member, said inner filter wall cover member having an undulating contour and a plurality of inner cover member apertures for insertion therein of said inner flexible dust protective member; and, (c) a pair of outer rectangularly contoured filters, each of said outer filters having an outer filter receiving frame insertable within a respective aperture of said respirator casing and having a closed contour flange insertable within said groove of a respective one of said frame members, said outer filter receiving frames having an outer filter wall member of undulating contour and having an inlet air opening formed through one end thereof, each of said outer filters having an outer flexible dust protective member sandwiched between said outer filter wall member on an outer filter wall cover member, said outer filter wall cover member having an undulating contour and a plurality of outer cover member apertures for insert of said outer flexible dust protective member.

2. The respirator as recited in claim 1 where said inner filter outlet air opening and said outer filter inlet air opening are formed on opposing ends respectively of said inner and outer filter.

3. The respirator as recited in claim 1 where said inner and outer cover member apertures are formed in alignment with apex sections of said inner and outer filter wall members.

4. The respirator as recited in claim 1 where said inner and outer filter wall members are triangularly contoured.

5. The respirator as recited in claim 1 where said inner and outer filter wall members are rectangularly contoured.

6. The respirator as recited in claim 1 where said inner and outer filter wall members are arcuately contoured.

* * * * *